US011154740B2

(12) United States Patent
Hume et al.

(10) Patent No.: US 11,154,740 B2
(45) Date of Patent: Oct. 26, 2021

(54) EXERCISE DEVICE FOR SQUAT MOVEMENT

(71) Applicant: HIGH STREET TV (GROUP) LIMITED, North Yorkshire (GB)

(72) Inventors: Josh Hume, West Yorkshire (GB); Luke Modeste, North Yorkshire (GB)

(73) Assignee: HIGH STREET TV (GROUP) LIMITED, North Yorkshire (GB)

( * ) Notice: Subject to any disclaimer, the term of this patent is extended or adjusted under 35 U.S.C. 154(b) by 3 days.

(21) Appl. No.: 16/480,890

(22) PCT Filed: Aug. 7, 2017

(86) PCT No.: PCT/EP2017/069966
§ 371 (c)(1),
(2) Date: Jul. 25, 2019

(87) PCT Pub. No.: WO2018/137790
PCT Pub. Date: Aug. 2, 2018

(65) Prior Publication Data

US 2020/0001128 A1 Jan. 2, 2020

(30) Foreign Application Priority Data

Jan. 25, 2017 (GB) ..... 1701220

(51) Int. Cl.
*A63B 21/00* (2006.01)
*A63B 21/04* (2006.01)
(Continued)

(52) U.S. Cl.
CPC ..... *A63B 21/00069* (2013.01); *A47C 9/002* (2013.01); *A63B 21/0428* (2013.01);
(Continued)

(58) Field of Classification Search
CPC .... A63B 2023/0411; A63B 2208/0223; A63B 23/0405; A63B 21/02; A63B 21/055;
(Continued)

(56) References Cited

U.S. PATENT DOCUMENTS 5,201,694 A 4/1993 Zappel
5,524,967 A 6/1996 Glöckl
(Continued)

FOREIGN PATENT DOCUMENTS

DE 20 2012 103466 10/2012
MX 2014001845 8/2015
(Continued)

OTHER PUBLICATIONS

International Search Report, PCT/EP2017/069966, dated Nov. 3, 2017.
Great Britain Search Report, GB1701220.4 dated May 18, 2017.

*Primary Examiner* — Jennifer Robertson
*Assistant Examiner* — Catrina A Letterman
(74) *Attorney, Agent, or Firm* — Nixon & Vanderhye

(57) ABSTRACT

An exercise device for performing squat movement including a base part for supporting the device against a surface, a first tube member attached to the base part, a second tube member movable with respect to the first tube member, an elastic member resisting the downward movement of the second tube member and moving upward the second tube member with respect to the first tube member, and a seat member for pressing down the second tube member, the seat member being attached to the second tube member.

10 Claims, 3 Drawing Sheets

(51) Int. Cl.

| | |
|---|---|
| ***A63B 21/055*** | (2006.01) |
| ***A63B 23/04*** | (2006.01) |
| ***A47C 9/00*** | (2006.01) |

(52) U.S. Cl.
CPC ..... *A63B 21/0557* (2013.01); *A63B 23/0405* (2013.01); *A63B 2023/0411* (2013.01); *A63B 2208/0223* (2013.01); *A63B 2225/093* (2013.01)

(58) Field of Classification Search
CPC ..... A63B 21/0552; A63B 21/0555; A63B 21/0557; A63B 21/00058; A63B 21/00069; A63B 21/00181; A63B 21/0407; A63B 2208/0228; A63B 2208/0233; A63B 25/08; A63B 25/02; A47C 7/02; A47C 9/002
See application file for complete search history.

(56) References Cited

U.S. PATENT DOCUMENTS

| | | | | | |
|---|---|---|---|---|---|
| 5,700,232 | A * | 12/1997 | Clausen | A63B 21/0552 482/125 |
| 6,062,638 | A * | 5/2000 | Ferguson | A47C 9/025 297/4 |
| 2010/0137105 | A1 | 6/2010 | McLaughlin | |
| 2012/0292968 | A1* | 11/2012 | Lee | A47C 7/42 297/313 |
| 2013/0072364 | A1 | 3/2013 | Chen | |
| 2014/0011646 | A1* | 1/2014 | Wu | A63B 21/4035 482/122 |
| 2015/0045193 | A1* | 2/2015 | Morton | A63B 23/085 482/123 |
| 2015/0305509 | A1* | 10/2015 | Verdier | A47C 3/22 297/174 R |
| 2019/0083845 | A1* | 3/2019 | Bouldstridge Balari | A47C 9/002 |
| 2019/0192902 | A1* | 6/2019 | Chen | A63B 21/0414 |

FOREIGN PATENT DOCUMENTS

| | | | |
|---|---|---|---|
| WO | WO 2010/082132 | 7/2010 | |
| WO | WO-2010082132 A1 * | 7/2010 | A63B 69/04 |
| WO | WO 2014/196434 | 12/2014 | |

* cited by examiner

100

EXERCISE DEVICE FOR SQUAT MOVEMENT

FIELD OF THE INVENTION

Generally the present invention relates to exercise equipment. In particular, however not exclusively, the present invention pertains to exercise devices for performing squat movement.

BACKGROUND

Exercising is quite the trend today, and there exists a wide variety of different devices for exercising as well. However, in spite of the large supply, one major problem still exists today. Unfit people find it hard to start exercising. For example, different devices available in gyms and for home use may require quite some strength to start with. Someone with little or no exercising background may feel discouraged after trying out a few times.

Another group of people who lack proper exercise equipment are people in rehabilitation. Rehabilitation from injuries often requires light workout with controlled exercise movements. Rubber bands and other tensioning equipment are used in rehabilitation, but movements are restricted to basic stretching movements that tension the rubber band, such as leg and arm extensions where the rubber band is attached to a wall.

Further, there is a need of exercise devices for people looking for a different approach to their fitness goals, e.g. greater number of repetitions or different exercises to keep their body guessing. Also, older people, who are not necessarily unfit or in rehab, but are out of practice or have lost confidence in their stability and ability to conduct body-weight squats with appropriate balance, are in need of exercise devices as well.

One efficient and widely known exercise movement is the squat movement. A squat movement is executed by a person taking a starting position by standing up with their legs straight (or slightly bent) in an approximately shoulder-wide stance. Thereafter, the movement is executed by moving the hips back and bending the knees and hips and lowering the torso. The second part of the movement consists of raising the torso by straightening the legs and hips. The person returns to the starting position.

There are some devices that are used with the squat movement. The most known, which is also used in strengthening training, is a barbell, alternatively with additional weights on the ends of the barbell. However, the squat movement in itself may already be challenging for many individuals and therefore extra weight only increases the resistance to and challenge of executing the movement. Especially people in rehabilitation and unfit people may find it hard to execute a squat movement with extra weight on their shoulders.

SUMMARY OF THE INVENTION

The objective is to at least alleviate the problems described hereinabove not satisfactorily solved by the known arrangements and to provide a feasible solution allowing squat exercise movements. One objective of the present invention is to assist in executing squat movements. Another objective of the present invention is to resist the downward movement of the squat movement.

The aforesaid objective(s) are achieved by the embodiments of an exercise device in accordance with the present invention.

The aforesaid objective(s) are achieved in accordance with the present invention as claimed in claim 1.

Accordingly, in one aspect of the present invention an exercise device for performing squat movement comprises

- a base part for supporting the device against a surface,
- a first tube member attached to the base part,
- a second tube member movable with respect to the first tube member,
- an elastic member resisting the downward movement of the second tube member and moving upward the second tube member with respect to the first tube member, and
- a seat member for pressing down the second tube member, the seat member being attached to the second tube member.

In one embodiment, the elastic member is a resistance band. The resistance band is preferably made of rubber. In alternative embodiments, the band is made of other elastic/resisting material. In an alternative embodiment, the elastic member is a spring.

In another, either supplementary or alternative, embodiment, first and second ends of the resistance band to be attached respectively to first and second attachment points on the outside of the first tube member, perforates the first tube member on higher locations than said first and second attachment points or goes around the edges of the first tube member, and perforates or goes around the second tube member in the lower end of the second tube member.

In a further, either supplementary or alternative, embodiment, the device comprises at least two resistance bands.

In a further, either supplementary or alternative, embodiment, the exercise device comprises a plurality of said first and/or second attachment points on different heights such that the resistance can be changed. In some embodiments, the attachment points comprise locking means for attaching/detaching the resistance band.

In a further, either supplementary or alternative, embodiment, the height of the seat member is adjustable. In some embodiments, the seat member is fixed to the second tube member. In some embodiments, the upper end of the second tube member forms the seat member.

In a further, either supplementary or alternative, embodiment, the first tube member is attached inclined to the base part for directing the device in a tilted angle towards the user such that the device is suitable for squat movement.

The utility of the present invention follows from a plurality of factors depending on each particular embodiment. The device may assist users starting squat training as the device may assist in the upward movement. The device assisting in the upward movement may help a user start his/her squat training. The device may also help people in rehabilitation by enabling controlled movements.

The expression "a number of" refers herein to any positive integer starting from one (1), e.g. to one, two, or three.

The expression "a plurality of" refers herein to any positive integer starting from two (2), e.g. to two, three, or four.

Different embodiments of the present invention are disclosed in the dependent claims.

BRIEF DESCRIPTION OF THE RELATED DRAWINGS

Next the invention is described in more detail with reference to the appended drawings in which FIG. 1*a* illustrates an embodiment of an exercise device in accordance with the present invention in an upper position with the seat member in its upper position.

FIG. 1*b* illustrates an embodiment of an exercise device in accordance with the present invention in an upper position with the seat member in its lower position.

FIG. 1*c* illustrates an embodiment of an exercise device in accordance with the present invention in its lower position (i.e. pushed in).

Figures 5A, 5B, 5C:
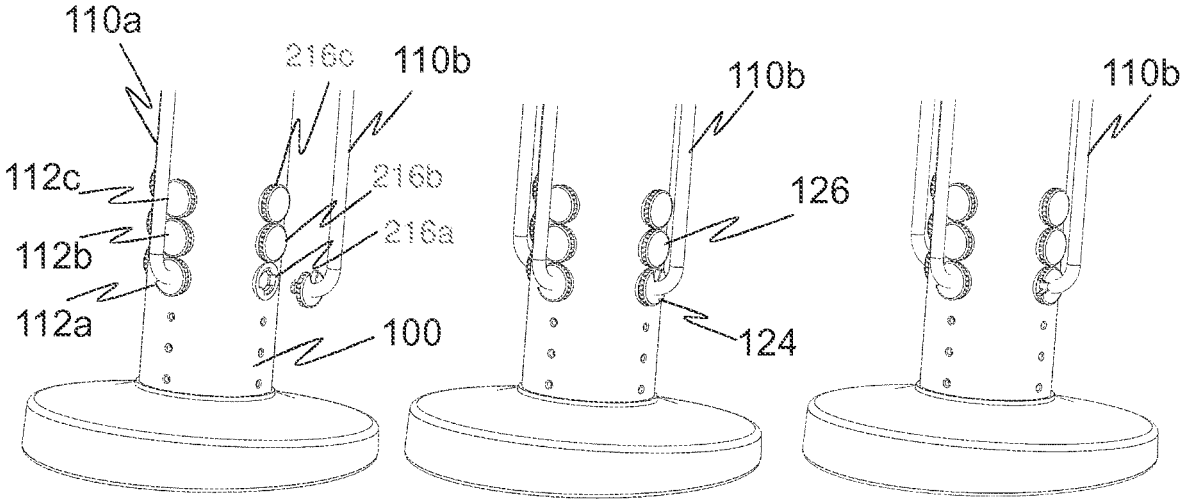

FIGS. 5*a*-5*c* illustrate an embodiment of the attachment points on the outside of the first tube member in accordance with the present invention.

DETAILED DESCRIPTION OF THE EMBODIMENTS

Figure 1A:
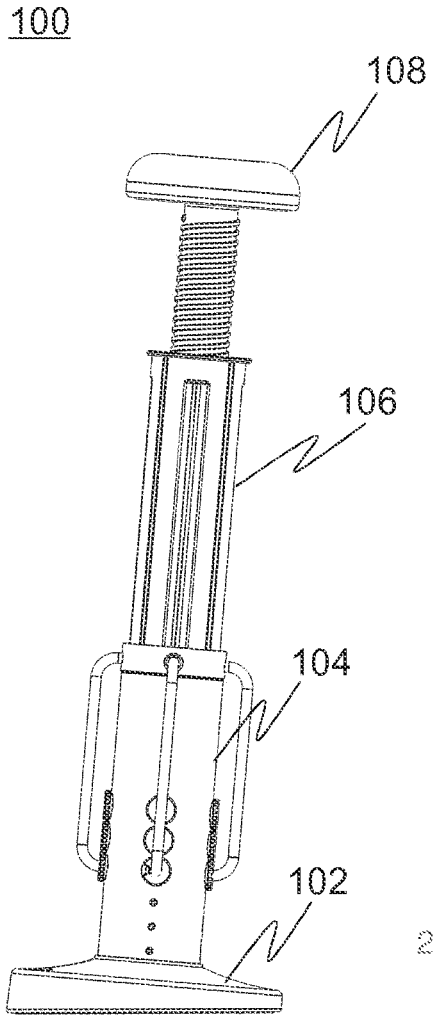
Figure 1B:
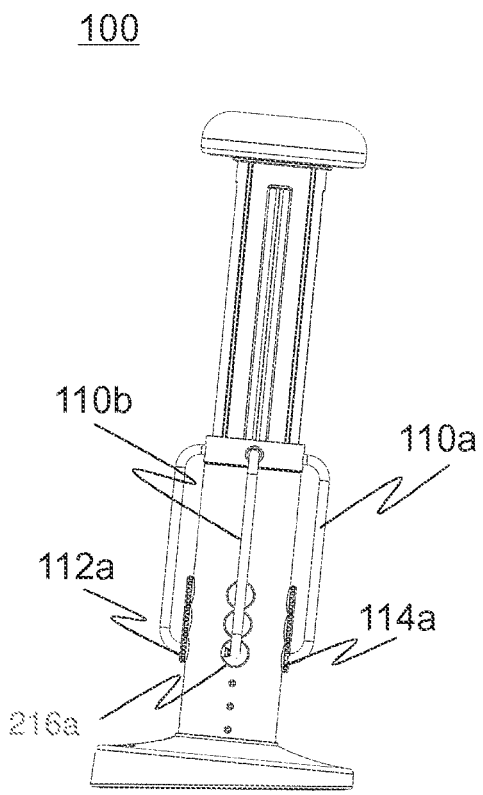
Figure 1C:
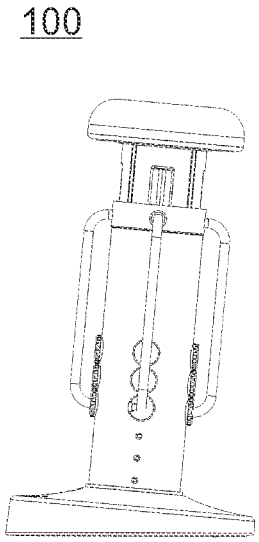

Referring to FIGS. 1*a*-1*c*, the exercise device 100 comprises a base part 102 that supports the exercise device against a surface such as the floor or ground. The exercise device 100 comprises a first tube member 104 attached to the base part 102. The first tube member 104 extends upwards from the base part. The first tube member 104 may be inclined connected to the base part, improving the usability for squat movement. The first tube member may form an angle with the base part of preferably 45-90 degrees, more preferably of 60-90 degrees and most preferably of 75-88 degrees. The first tube member 104 may be attachable to/detachable from the base part 102 such that the exercise device is easy to assemble.

A second tube member 106 is arranged within the first tube member 104 such that the second tube member 106 is movable with respect to the first tube member 104. A seat member 108 is connected to the second tube member 106. The height of the seat member 108 is adjustable for adjusting the height of the exercise device such that it fits a user. The seat member may comprise threads for adjusting the height. In FIG. 1*a*, the seat member is illustrated in its upper position whereas in FIGS. 1*b* and 1*c* the seat member is illustrated in its lower position.

In FIGS. 1*a* and 1*b*, the exercise device 100 is illustrated in its upper starting position. The elastic members 110*a* and 110*b* push the second tube member 106 upwards, simultaneously resisting the downward movement. The user positions themselves slightly in front of the device, placing their behind on the seat member 108. By lowering their torso, the user presses the second tube member downwards. In FIG. 1*c*, the exercise device 100 is illustrated in its lower position. The exercise device may also be locked in to the lower position such that exercise device works as a stool and/or the exercise device takes less storage space. The second tube member 106 may comprise a pin close to the upper edge and the first tube member may comprise an L-shaped groove close to the upper edge in which the pin is secured by rotating the second tube member.

The height of the exercise device in its upper position with the seat member in its upper position is preferably 50-150 cm, more preferably 70-110 cm and most preferably 80-100 cm. The height of the seat member is adjustable by preferably 10-30 cm. The height of the exercise device in its lower position is preferably 25-65 cm, more preferably 30-60 cm and most preferably 35-55 cm.

Figure 2:
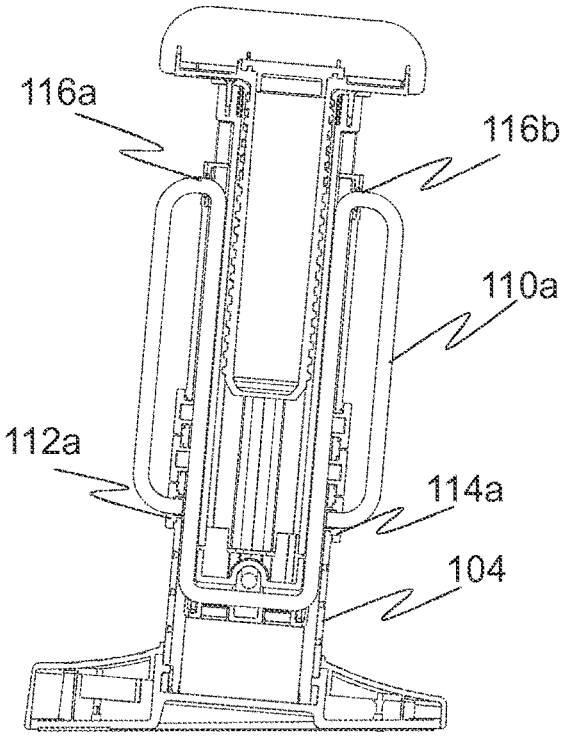
FIG. 2 illustrates a cross-section of an embodiment of an exercise device in accordance with the present invention (in the lower position).
Figure 3:
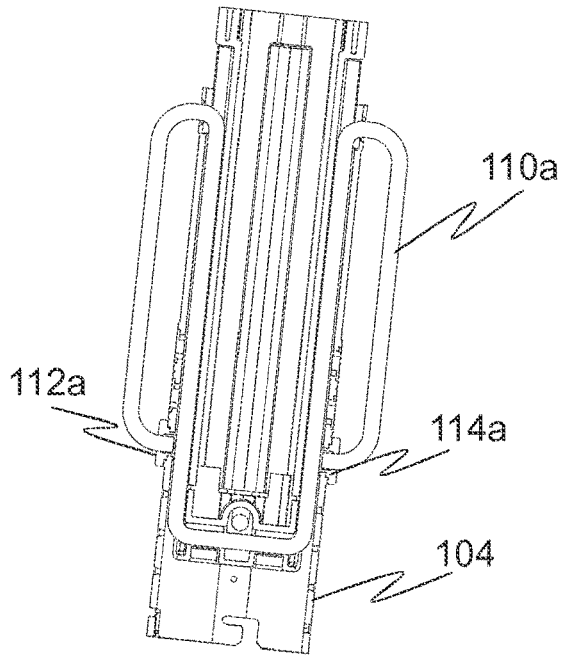
FIG. 3 illustrates a cross section of an embodiment of the first and second tube members in accordance with the present invention.

Referring also to FIGS. 2-3, the first elastic member 110*a* attaches to a first and second attachment point 112*a*, 114*a* on the outside of the first tube member 104. The attachment points 112*a*, 114*a* are preferably located on the opposite sides of the first tube member 104. The elastic member 110*a* perforates the first tube member 104 a first and a second time on higher locations than the attachment points 112*a*, 114*a*. The first tube member comprises a first and second hole 116*a*, 116*b* such that the elastic member 110*a* may perforate the tube. The elastic member 110*a* perforates the second tube member 106 in its lower end. The lower end is preferably the lower half of the second tube member, more preferably the lower ⅓ of the tube and most preferably the lower ¼ of the tube member. Alternatively, the elastic member 110*a* may go around the upper edges of the first tube member 104 and/or go around the lower end of the second tube member 106.

The exercise device comprises, preferably, a second elastic member 110*b*. The second elastic member is preferably substantially perpendicular to the first elastic member 110*a*. The second elastic member 110*b* attaches similarly as the first elastic member from its both ends to a first 216*a* and second (not in figure) attachment point. Alternatively, the exercise device comprises more than two elastic members. Some embodiments may only comprise one elastic member. The elastic members are preferably resistance bands.

Alternatively, the elastic member is a spring. The spring may be arranged within the first tube member, underneath the second tube member, for example.

Figure 4:
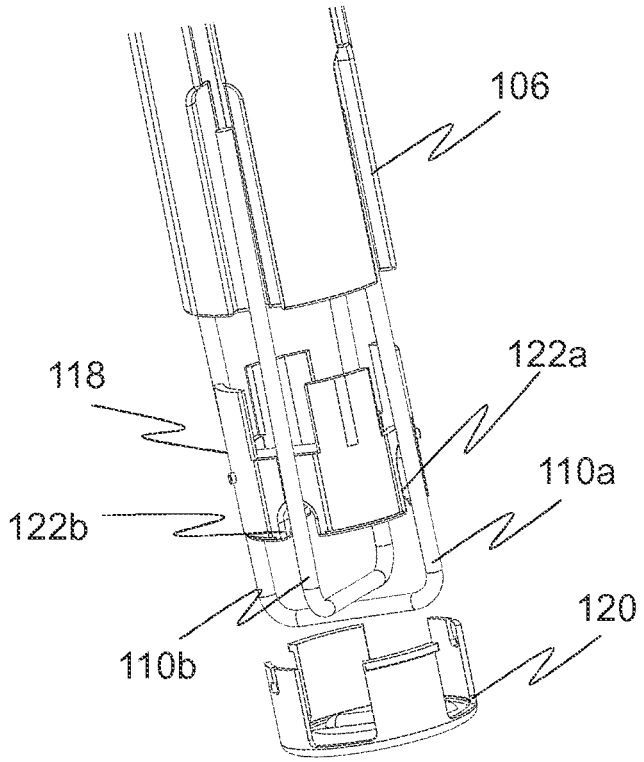
FIG. 4 illustrates an embodiment of the lower end of the second tube member in accordance with the present invention.

Referring to FIG. 4, the lower end of the second tube member 106 comprises two fitting parts 118, 120 for securing the elastic members 110*a*, 110*b*. The first fitting part 118 comprises channels 122*a*, 122*b* for the elastic members 110*a*, 110*b* to perforate the second tube member. The second fitting part 120 works as a cover, securing the elastic members 110*a*, 110*b* within the second tube member.

Referring also to FIGS. 5*a*-5*c*, the exercise device 100 comprises first and second attachment points on different heights such that the resistance of the elastic member can be adjusted. In a preferable embodiment, the exercise device comprises attachment points on three different heights. FIGS. 5*a*-5*c* illustrates the first attachment points 112*a*-*c* for the first elastic member 110*a* and the first attachment points 216*a*-*c* for the second elastic member 110*b*. Similarly, the exercise device comprises second attachment points for the first and second elastic member, preferably, substantially on the opposite side of the tube with respect to the first attachment points. The lowest attachment points give most resistance. The resistance can be lightened by moving the elastic members upwards.

The attachment points comprise plugs 124 for attaching/detaching the elastic members. FIG. 5*a* illustrates the second elastic member 110*b* detached from the attachment point. In FIG. 5*b*, the elastic member 110*b* is placed in, and in FIG. 5*c* the elastic member is locked in place. The attachment points not in use comprise caps 126 for safety.

Consequently, a skilled person may on the basis of this disclosure and general knowledge apply the provided teachings in order to implement the scope of the present invention as defined by the appended claims in each particular use case with necessary modifications, deletions, and additions.

The invention claimed is:

1. An exercise device for performing squat movement, the exercise device comprising:

a base part for supporting the device against a surface, a first tube member attached to the base part, a second tube member movable with respect to the first tube member, a resistance band configured to resist the downward movement of the second tube member and moving upward the second tube member with respect to the first tube member, and a seat member for pressing down the second tube member, the seat member being attached to the second tube member, wherein first and second ends of the resistance band are attached respectively to first and second attachment points on an outside of the first tube member, the resistance band perforates the first tube member on higher locations than said first and second attachment points or the resistance band goes around the edges of the first tube member, and the resistance band perforates or goes around the second tube member in the lower end of the second tube member.

2. The exercise device according to claim 1, wherein the device comprises at least two resistance bands.

3. The exercise device according to claim 1, wherein the exercise device comprises a plurality of said first and/or second attachment points on different heights such that the resistance can be changed.

4. The exercise device according to claim 1, wherein a height of the seat member is adjustable.

5. The exercise device according to claim 1, wherein the first tube member is attached inclined to the base part for directing the device in a tilted angle towards the user such that the device is suitable for squat movement.

6. The exercise device according to claim 2, wherein a height of the seat member is adjustable.

7. The exercise device according to claim 3, wherein a height of the seat member is adjustable.

8. The exercise device according to claim 2, wherein the first tube member is attached inclined to the base part for directing the device in a tilted angle towards the user such that the device is suitable for squat movement.

9. The exercise device according to claim 3, wherein the first tube member is attached inclined to the base part for directing the device in a tilted angle towards the user such that the device is suitable for squat movement.

10. The exercise device according to claim 4, wherein the first tube member is attached inclined to the base part for directing the device in a tilted angle towards the user such that the device is suitable for squat movement.

* * * * *